US010874953B2

(12) United States Patent
Fabrizi

(10) Patent No.: US 10,874,953 B2
(45) Date of Patent: Dec. 29, 2020

(54) SNOWBALL FORMING APPARATUS, AND METHOD OF USE

(71) Applicant: Daniel Fabrizi, Garden City, NY (US)

(72) Inventor: Daniel Fabrizi, Garden City, NY (US)

( * ) Notice: Subject to any disclaimer, the term of this patent is extended or adjusted under 35 U.S.C. 154(b) by 0 days.

(21) Appl. No.: 16/686,167

(22) Filed: Nov. 17, 2019

(65) Prior Publication Data

US 2020/0155955 A1 May 21, 2020

Related U.S. Application Data

(60) Provisional application No. 62/770,100, filed on Nov. 20, 2018.

(51) Int. Cl.

| | |
|---|---|
| ***A63H 33/00*** | (2006.01) |
| ***F41B 3/00*** | (2006.01) |
| ***A63B 65/12*** | (2006.01) |
| ***F42B 5/14*** | (2006.01) |
| ***F25C 5/14*** | (2006.01) |

(52) U.S. Cl.

CPC ..... *A63H 33/001* (2013.01); *A63B 65/122* (2013.01); *F25C 5/14* (2013.01); *F25C 2305/022* (2013.01)

(58) Field of Classification Search

CPC ..... A63H 33/00; A63H 33/001; A63H 33/18; A63H 33/32; A63B 65/122; F41C 5/14; F41B 3/04; F25C 5/14; F25C 2305/022

USPC ..... 124/1, 5, 79; 425/276, 318

See application file for complete search history.

(56) References Cited

U.S. PATENT DOCUMENTS

| | | | | | |
|---|---|---|---|---|---|
| 1,826,651 | A * | 10/1931 | Chisholm | A47J 43/282 | 425/221 |
| 2,948,275 | A * | 8/1960 | Smith | A63B 45/00 | 124/27 |
| 3,059,273 | A * | 10/1962 | Blevins, Jr. | A63H 33/00 | 425/318 |
| 3,472,217 | A * | 10/1969 | Erickson | A63H 33/00 | 124/5 |
| 3,836,308 | A * | 9/1974 | Upright | A63H 33/001 | 425/318 |
| 4,163,639 | A * | 8/1979 | Stern | A63H 33/00 | 249/161 |
| 5,000,153 | A * | 3/1991 | Zimmerman | F41B 3/00 | 124/5 |
| 7,128,556 | B2 * | 10/2006 | Wessells | F41B 3/04 | 425/276 |

(Continued)

*Primary Examiner* — Alexander R Niconovich

(74) *Attorney, Agent, or Firm* — Carrie M. Stroup

(57) ABSTRACT

A snowball forming apparatus, and method of use, disclosed herein comprises: an elongated shaft and handle; a funnel shaped cover encircling and covering the shaft up to the handle, and the shaft is slide-able within the cover; and a plurality of grapples connected to the distal end of the shaft, and moveable between an open position to collect snow and release a snowball, and a closed position to form a spherical snowball. The apparatus further comprises a plurality of hinge mechanisms connecting the shaft to the grapples to open and close the grapples by pushing the shaft out of the cover (open grapples) and pulling on the shaft (close grapples). In an embodiment, the apparatus comprises a shaft with a triangular cross-section, three concave grapples, and one spring-actuated hinge per grapple. The user is not required to significantly bend over or touch the snow in order to make snowballs.

16 Claims, 5 Drawing Sheets

(56) References Cited

U.S. PATENT DOCUMENTS

| | | | | |
|---|---|---|---|---|
| D549,789 | S * | 8/2007 | Erickson | F41B 3/04<br>D21/722 |
| 7,815,429 | B1 * | 10/2010 | Clark, Jr. | F41B 3/04<br>425/276 |
| 8,302,585 | B2 * | 11/2012 | FitzGerald | F41F 7/00<br>124/5 |
| 10,646,760 | B2 * | 5/2020 | Hinnen, III | A63B 59/50 |
| 2007/0295317 | A1 * | 12/2007 | Erickson | A63H 33/18<br>124/5 |
| 2009/0252822 | A1 * | 10/2009 | Palmer | F25C 5/14<br>425/318 |
| 2011/0011384 | A1 * | 1/2011 | Michael | F41B 7/006<br>124/17 |
| 2018/0326272 | A1 * | 11/2018 | Hinnen, III | A63B 65/122 |

* cited by examiner

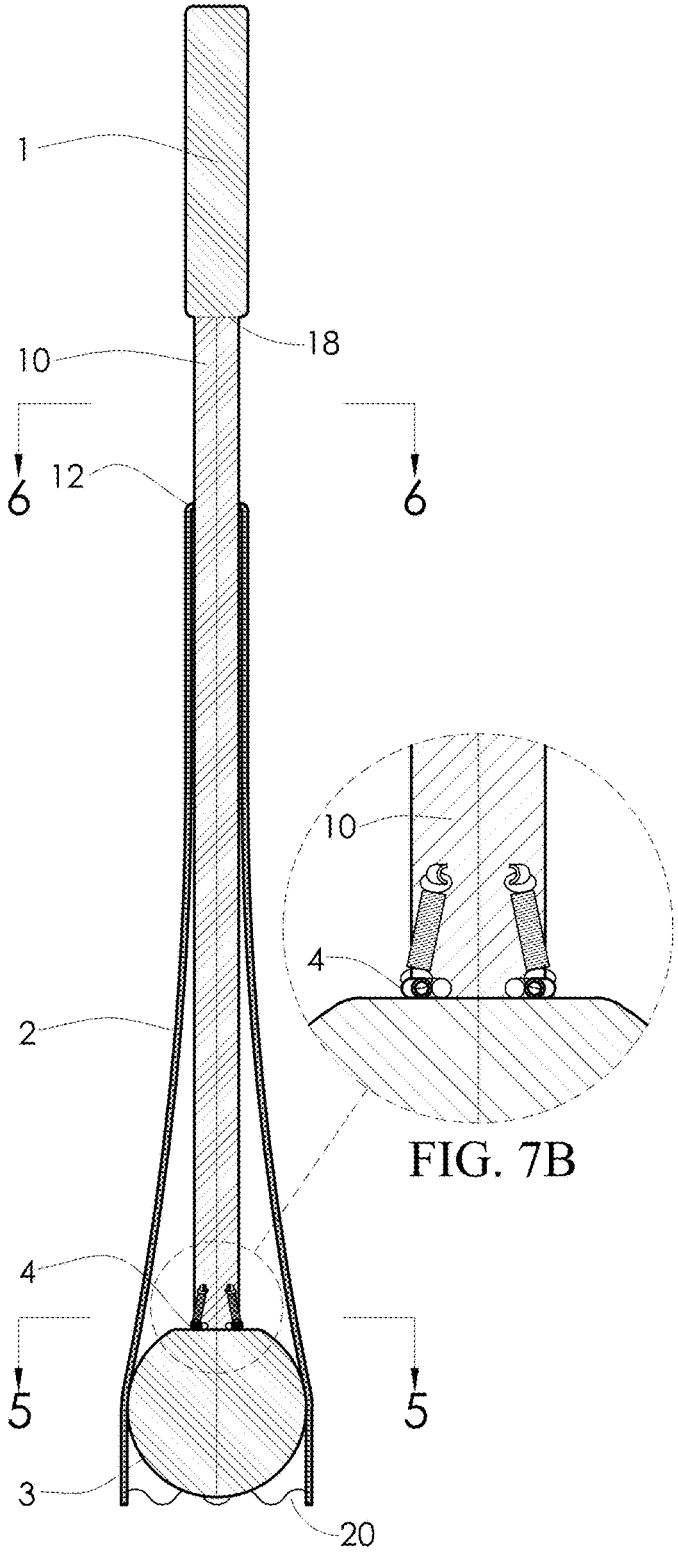
FIG. 7B
FIG. 7A
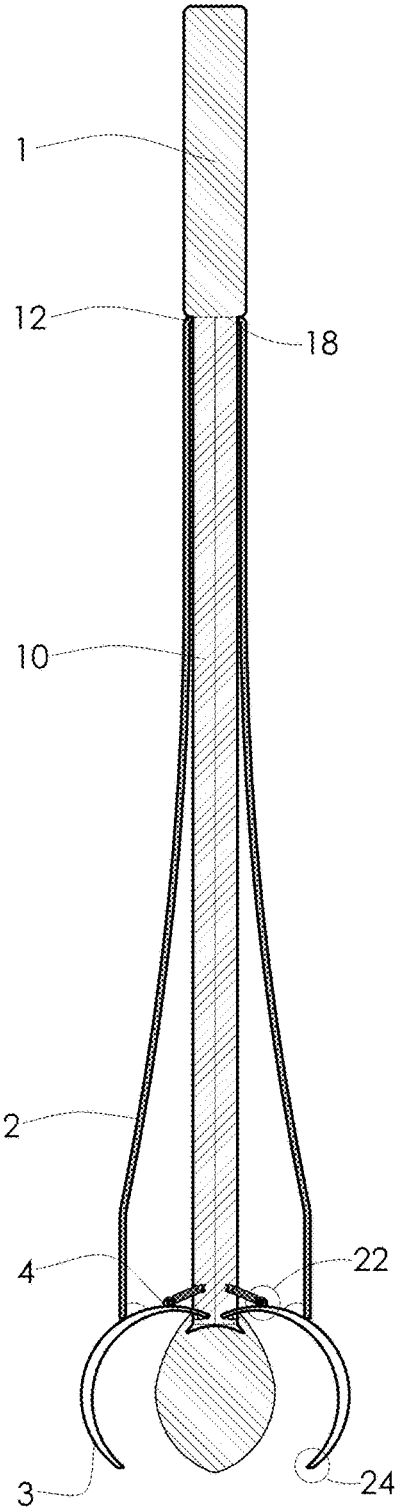
FIG. 8

SNOWBALL FORMING APPARATUS, AND METHOD OF USE

PRIORITY CLAIM

This utility patent application claims priority to U.S. Provisional Patent Application Ser. No. 62/770,100 filed on Nov. 20, 2018, which is incorporated herein by reference in its entirety.

FIELD OF THE INVENTION

The present invention relates generally to a toy mechanical apparatus, and its method of use, for forming a spherical snowball without the user having to touch the snow.

BACKGROUND OF THE INVENTION

The prior art teaches a variety of snowball formation toys, which may further comprise a combination apparatus with a snowball launch mechanism. U.S. Pat. No. 3,836,308, by Upright R, which issued Sep. 17, 1974, discloses a snowball forming apparatus comprising two hollow half-spheres with handles to compress snow into a snowball. The user is required to bend down and manually scoop the snow into the half spheres and remove excess snow.

Combination apparatuses comprise, for example, U.S. Pat. No. 8,302,585 B2, by Wham-O Inc., which issued Nov. 6, 2012, comprises one hollow half-sphere facing a large scoop member, which requires the user to bend over to the ground, scoop up the snow and push it into the half-sphere, then release the half-sphere and fling the snowball from the scoop member.

Likewise, U.S. patent Application Ser. No. 20110011384 A1, by Tom Michael et al., which published on Jan. 20, 2011, comprises a hopper on top of a launch tube, to manually place snow into hollow spheres. The backwards motion of a handle compacts the snow into a ball and stores energy in elastic bands for launching, and the release of the handle propels the snowball through the launch tube.

And, U.S. Design Pat. No. D549789 S1, by Duane Erickson, which issued on Aug. 28, 2007, comprises a stick with a small cone on the distal end to compress the snow into a cone or ball shape, and then to fling it with the stick.

And U.S. Patent Application Ser. No. 20180326272 A1, to John Hinnen, III, which published Nov. 15, 2018, comprises a stick that collapses into a barrel member having a hollow half-sphere on the stick end to form snowballs. The snowball is launched by forcefully pushing the stick into the barrel.

It is noted that in the apparatuses comprising only one hollow half-sphere, the snowball is not symmetrically round unless the user manually rotates the ball in the sphere, and only if the apparatus permits access to this.

The apparatus of the present invention remedies the shortcomings of the prior art by not requiring the user to bend over, squat, or sit on the ground to form snowballs; and by forming perfectly shaped spherically balls without requiring the user to touch the snow.

SUMMARY OF THE INVENTION

The various embodiments of the present invention comprise a toy apparatus for forming perfectly spherical snowballs without having to bend over and touch snow on the ground. One or more embodiments of the snowball forming apparatus, comprise: a shaft member comprising an elongated shaft and a handle; a substantially cone or funnel shaped cover member encircling and covering the shaft member up to the handle, wherein the shaft member is longitudinally slide-able within the cover member; and a plurality of grapples connected to a shaft member distal end, and moveable between an open position to collect snow and release a snowball, or a closed position to form a spherical snowball.

The snowball forming apparatus may further comprise a handle coating the shaft on the apparatus proximal end; or, a notch or the like on the shaft to prevent the cover from sliding over the shaft proximal end and hitting the user's hand. In an embodiment, the handle comprises a rubber water-proof and non-slip material to enable a user to securely, and comfortably grasp the apparatus at the proximal end.

The cover member comprises a small circular top opening on the cover proximal end to enable the shaft to slide up and down within the cover without friction or wobbling; and a large circular bottom opening on the cover distal end that is wide enough to fit the grapples in a closed position. Hence, when the apparatus is in an extended position, the grapples are closed within the cover member with the handle and cover separated; and when the apparatus is in a contracted position, the grapples are open and positioned outside of the cover member, and the handle and cover are touching.

The apparatus further comprises a plurality of hinge mechanisms connecting the shaft member distal end to the grapples, so as to open and close the grapples. In an exemplary embodiment, the hinge mechanism comprises per each grapple, a spring actuated mechanism attached on one end to the shaft member distal end, and on the opposing end to a grapple top end. The spring actuated mechanism is able to pull the grapple closed when the handle and cover are separated; and is able to push the grapple open when the handle and cover are touching.

In an embodiment exemplified in the figures herein, the apparatus comprises three concave sections with substantially pointed or curved bottom ends to facilitate piercing through and scooping up ground snow, wherein the grapples are uniform in size and shape, and able to form a sphere when the grapples are closed. Furthermore, the shaft member comprises a triangular cross-sectional area, with each of the three sides of the shaft attached to one grapple via one hinge mechanism.

The present invention further comprises a method of use, comprising: a) providing a snowball forming apparatus as disclosed herein; b) pushing the shaft member downward through the cover member, e.g. until the handle touches the cover, to extend and open the plurality of grapples; c) positioning the grapples within loose snow until the grapples are completely covered in snow; d) pulling on the handle with the shaft member through the cover member to retract and close the grapples to form a spherical snowball; and e) repeating step (b) to release the snowball.

An object of the present invention is the ability to make snowballs that are uniform in size and shape, e.g. a plurality of snowballs that form a perfect sphere of the same size. This is especially beneficial when making snow sculptures.

Another object is the user is not required to manually bend down, or squat, or sit on, and dig into the snow in order to pack it into a snowball forming and/or throwing apparatus.

Another object of the present invention is to use the apparatus to launch the snowball by opening the grapples on a formed snowball while simultaneously and forcefully swinging the apparatus in a throwing motion.

Objects, features, and advantages of the invention will be brought out further in the following part of the specification, wherein detailed description is for the purpose of fully disclosing the invention without placing limitations thereon.

BRIEF DESCRIPTION OF THE DRAWINGS

The accompanying drawings, which are incorporated herein and form a part of the specification, illustrate some, but not the only or exclusive, examples of embodiments and/or features. It is intended that the embodiments and figures disclosed herein are to be considered illustrative rather than limiting. In the drawings:

FIG. 7A is a longitudinal cross-sectional view of the snowball apparatus of FIG. 1 illustrating the grapples in a closed position within the cover.

FIG. 7B is an exploded view of the spring-actuated mechanism of FIG. 7A illustrating the springs in a substantially vertical position when the grapples are closed, and the handle-shaft is extended upward.

FIG. 8 is a longitudinal cross-sectional view of the snowball apparatus of FIG. 2 with the grapples in an open position.

DETAILED DESCRIPTION OF EXEMPLARY EMBODIMENTS

Figure 1A:
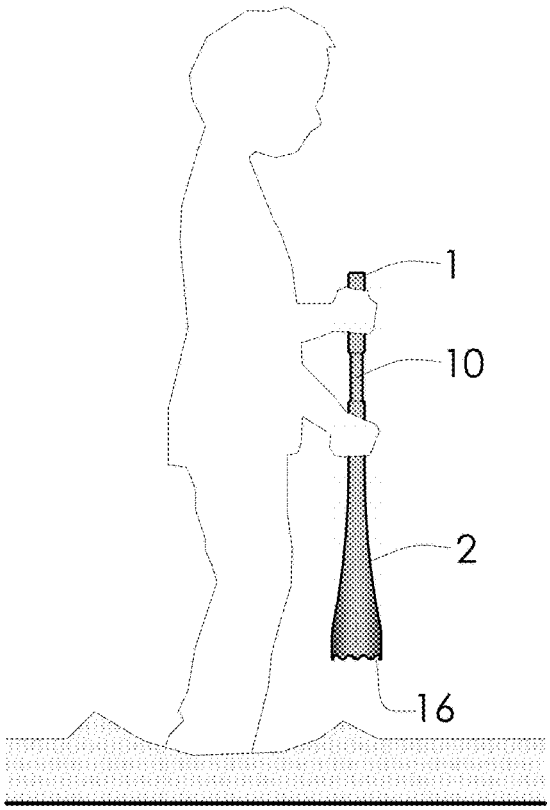
FIG. 1A is a side view of a user preparing to use the snowball apparatus in which the grapples are in a closed position within the cover, and the cover and handle-shaft unit are extended in opposing directions.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase; and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

The term "about" as used herein refers to plus or minus 10 percent of the stated amount, preferably 5 percent, and most preferably 1 percent.

The term "substantially" as used herein refers to a significantly similar geometric shape as recognized by one of ordinary skill in the art.

The term "distal" as used herein refers to the far end of the apparatus in relation to the user, e.g. the end that is inserted into the ground snow. Likewise, the term "proximal" as used herein refers to the apparatus end closest to the user (e.g. the handle, shaft and grapples top end, etc.).

In this description, the directional prepositions of up, upwardly, down, downwardly, front, back, top, upper, bottom, lower, left, right and other such terms refer to the apparatus as it is oriented and appears in the drawings and are used for convenience only; they are not intended to be limiting. It is also noted that the apparatus may come in different sizes, e.g. to shape different size snowballs, and/or for use by children or adults (e.g. the shaft is longer for adults).

Referring to the accompanying drawings FIG. 1A through FIG. 8, demonstrate that the components of the apparatus of the present invention comprise from top (proximal) to bottom (distal): a handle 1 covering an elongated shaft member 10 on the apparatus proximal end 18; a substantially cone or funnel shaped cover 2 on top of the shaft member 10 with a small circular proximal opening 12 that the shaft 10 is able to easily slide through up to the handle 1; a plurality of grapples 3 connected to the shaft 10 distal end 14 via a hinge mechanism 4 that moves the grapples between an open and closed position when the handle 1 is pushed downward (open grapples) or pulled upward (closed grapples).

The handle 1 coats the exterior surface of the shaft 10 at the shaft or apparatus proximal end 18; and it is made of waterproof, non-slip material that is able to facilitate the user securely and comfortably grabbing the shaft member 10. In an embodiment, the handle is made of rubber, but other durable waterproof, non-slip materials are readily apparent to one of ordinary skill in the art; and is cylindrical in shape.

The shaft 10 is, in an embodiment, a triangular member, that is hollow or solid, comprising materials, such as: wood, plastic, etc. The shaft 10 may comprise other shapes, such as by way of non-limiting examples—tubular or square; and the shaft shape is largely dependent upon the number of grapples and types of hinge mechanisms connecting the grapples to the shaft 10. In the exemplified embodiment disclosed within the figures, the entire apparatus is made of durable, lightweight, water-proof plastic, except for the metal springs 4.

The substantially cone or funnel shaped cover 2 is positioned to hide the shaft middle section, and the bottom (distal) end 14. Cover 2 is made of a durable water-proof material, such as plastic, which the user is able to securely grab and slide the shaft 10 up/down within the cover 2. Cover 2 is wide enough on the distal end to fit the grapples 3 in their closed position that forms a sphere. In an embodiment, the grapples may rub against the interior surface of the cover 2 when moving between the open and closed position without damaging the cover. In another embodiment, grapples 3 do not make contact with the interior surface of the cover 2.

Likewise, the shaft 10 is able to slide through the thin neck of the cover 2 comprising a small circular opening 12, repeatedly without damaging the cover interior surface or the shaft. The distal cover end 16 can be decorative, such as illustrated in the figures (e.g. FIGS. 1A, 2) with the wavy design, as long as no sharp edges extend that could injury the user; or it can be a straight circular line as in the proximal (top) opening 12 of the cover.

As illustrated in FIGS. 5-8, grapples 3 connect to the bottom (i.e. distal end 14) of shaft 10 using a hinge mechanism 4 that moves the grapples between an open position to scoop up snow or to release a snowball formed therein. A variety of grapple shapes and number are envisioned within the scope of the present invention as long as they easily scoop up snow (three grapples of various shapes; two large grapples shaped like half a sphere each; two heart shaped grapples to form a three dimensional heart of snow, etc.).

Likewise, a variety of hinge mechanisms are useable with the grapples 3, such as by way of non-limiting examples: spring-actuated, screws, bendable plastic pieces, etc. In most situations, each grapple would have one hinge mechanism; and one of ordinary skill in the art would readily know of the type of hinge the most effectively use with a particular grapple shape.

Figure 1B:
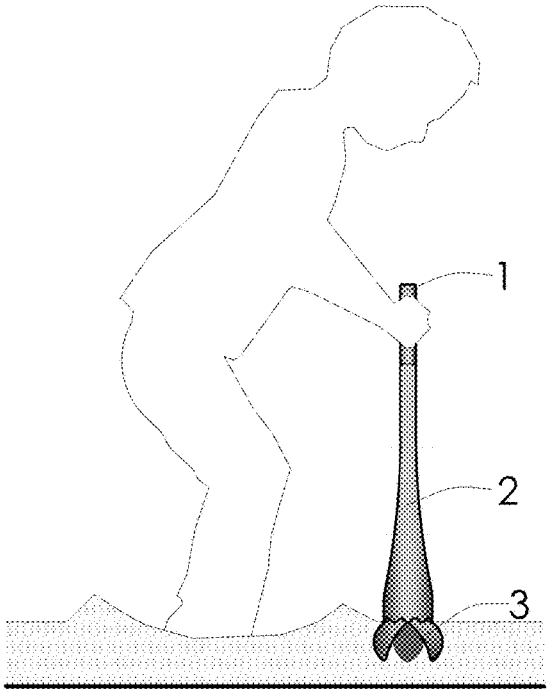
FIG. 1B is a side view of the user inserting the snowball apparatus into the snow on the ground with the grapples open, upon which the user pushes the handle and shaft downward to close the grapples to scoop up and form a snowball within.
Figure 2:
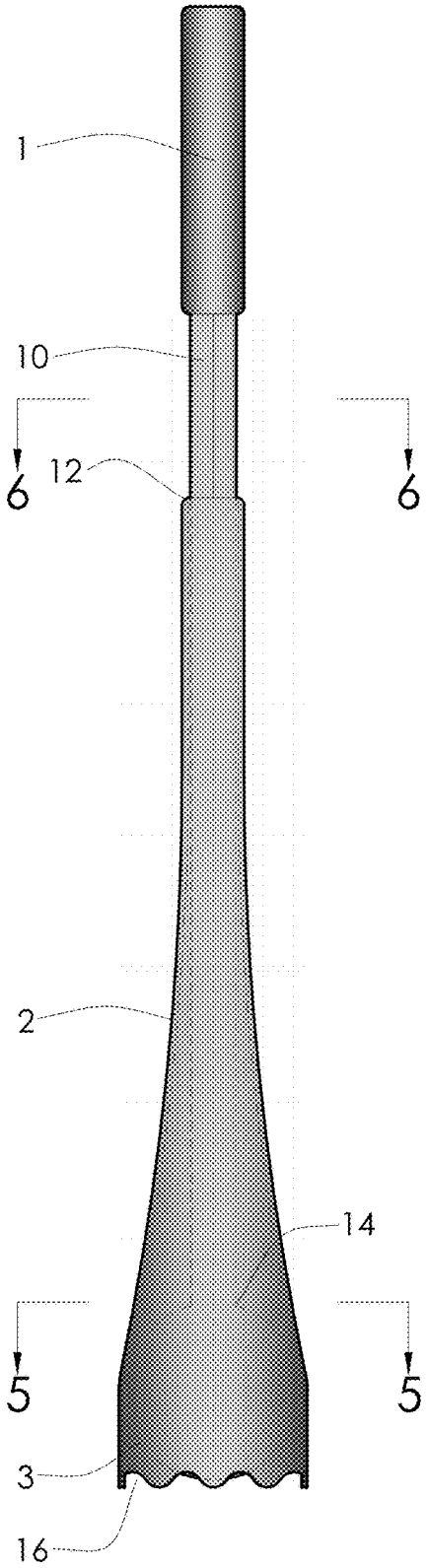
FIG. 2 is another side view of the snowball apparatus in the closed position, such as after releasing a snowball.
Figure 3:
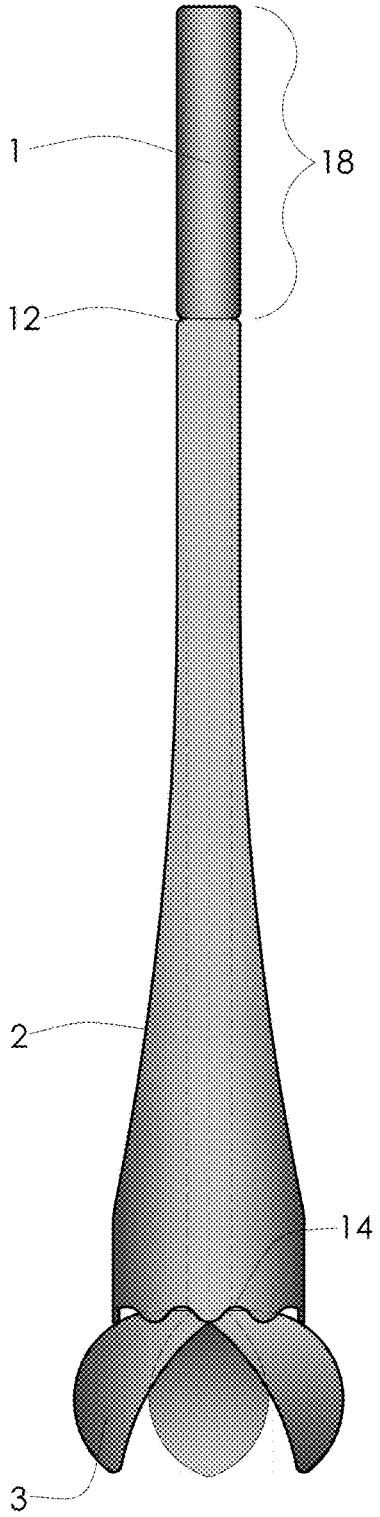
FIG. 3 is another side view of the snowball apparatus in the open position with the grapples extended outward to scoop up snow, and/or to release a formed snowball.

FIGS. 1A and 1B demonstrate the apparatus in use from a closed position with the shaft 10 extended to an open position with the handle 1 and shaft 10 pushed downward. The elevational view in FIG. 2 shows the apparatus as viewed from the side demonstrating the apparatus in the closed position, or with the grapples 3 constrained. FIG. 3 shows the apparatus as viewed from the side demonstrating the apparatus in the open position, or with the grapples 3 released, or rotated outward.

Figure 4:
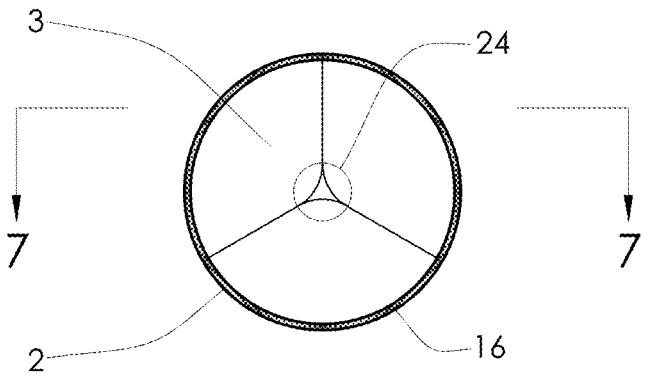
FIG. 4 is a bottom view of the snowball apparatus illustrating the grapples in a closed position.
Figure 5:
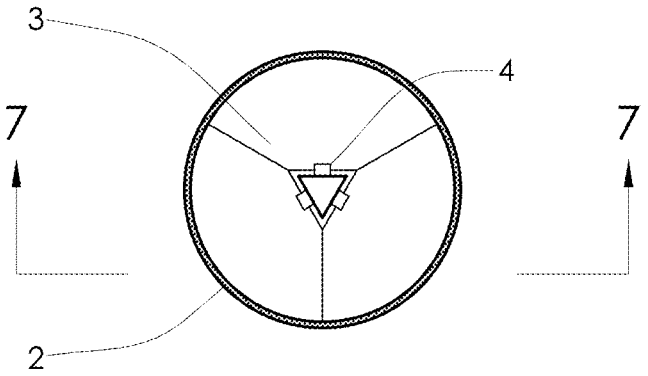
FIG. 5 is a horizontal cross-sectional view of FIG. 2 right above the grapples and shaft juncture, which illustrates the grapples in a closed position the spring-actuated mechanism to open and close the grapples when the handle is pushed and pulled in, respectively.
Figure 6:
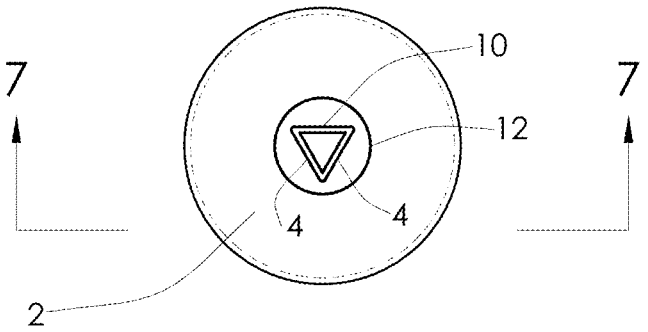
FIG. 6 is a horizontal cross-sectional view of the shaft of FIG. 2, illustrating the grapples in a closed position within the cover.

FIGS. 4-6 are horizontal cross-sectional views taken along the lines of FIG. 7A. Plan view FIG. 4 is a view from distal end 16 (i.e. below) of the apparatus in the closed position, or grapples 3 constrained.

FIG. 5 is a horizontal cross-sectional view taken along line 5-5 of FIG. 2, which is just above of the grapples 3 in their closed position, or constrained, (e.g. at the shaft distal end 14), which also demonstrates the spring-actuated hinges 4 connecting the grapples 3 to shaft 10.

And FIG. 6 is a horizontal cross-sectional view taken along line 6-6 of FIG. 2, which is immediately below handle 1 of the apparatus to demonstrate the triangular contour of the shaft 10, within the cover top circular opening 12 that allows the shaft 10 to slide through the cover without contacting the cover interior surface, and an overall plan view of cover 2 below it when the grapples are closed.

FIG. 7A is a longitudinal cross-sectional view of the apparatus in the closed position, or grapples 3 constrained, and FIG. 7B is an exploded view of one type of hinge mechanism 4 that enables the grapples 3 to open and close in conjunction with the movement of the shaft 10 relative to the cover 2. Section FIG. 8 is longitudinal cross-sectional view of the apparatus in the open position, or grapples 3 released, or rotated outward with the shaft 10 pushed into the cover 2 up to the handle 1.

Figure 9:
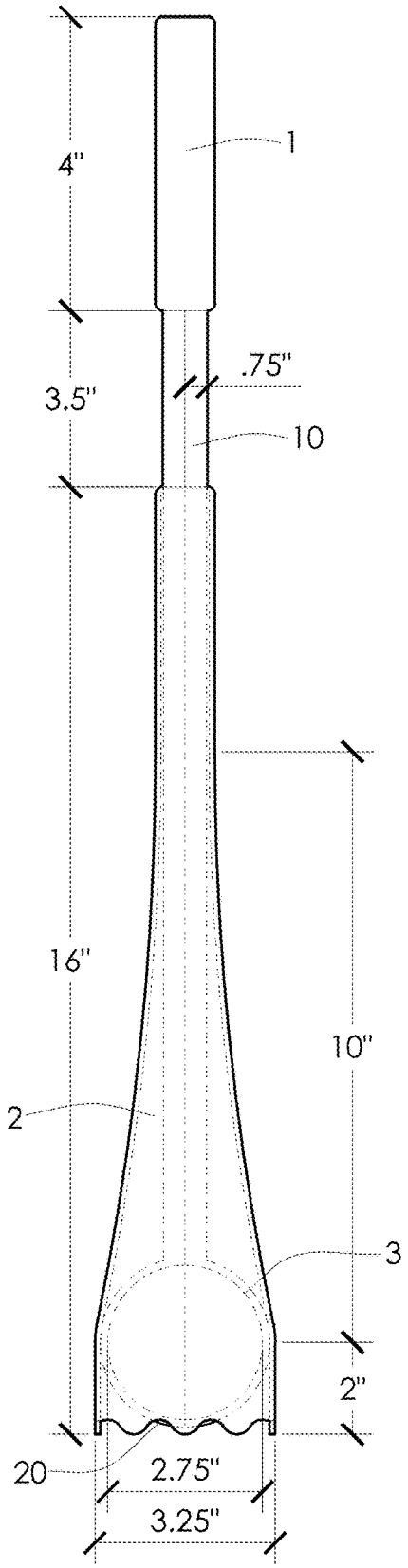
FIG. 9 is a side view of an exemplary snowball apparatus illustrating dimensions in inches of apparatus parts.

FIG. 9 is a side view of an exemplary snowball apparatus showing one embodiment of the apparatus dimensions, comprising: handle 1 of 4 inches in length; a cover 2 of 16 inches in length; exposed part of the shaft 10 of 3.5 inches (i.e. maximum extension between handle 1 and cover 2); and a closed sphere of grapples 3 with an interior diameter of 2.75 inches, while the distal end 20 of the apparatus has a diameter of 3.25 inches.

Method of Use

The process of making a spherical snowball using the apparatus of the present in invention is initiated by inserting the apparatus grapples 3 into a body of snow when the grapples 3 are in an open or the released position as shown in FIG. 3. The top of the snow level should at least cover the grapples (as shown in FIG. 1B).

With one user hand placed on handle 1 and the other user hand placed on cover 2, the user pulls cover 2 and handle 1 away from each other to close the grapples 3 to form a snowball (e.g. see FIG. 2). Alternatively, the user keeps the cover 2 in position, and pulls the handle 1 and shaft 10 upward through the cover until the grapples 3 are closed into a sphere within the cover. The forming of a snowball is achieved by forcing shaft 10 to slide over, closing, and covering the grapples 3, thus engaging the grapples 3 and compressing the grapples 3 around the snow to form a perfectly spherical ball.

After the user removes the apparatus from the snow, the user pulls on the apparatus handle 1 and cover 2 apart from each other to open or retract the grapples 3 and release the formed snowball. The grapples 3 are released, or rotate outward, by means of the vertically oriented spring-actuated hinges 4 which connects the grapples 3 to the handle 1 forming one unit. Handle 1 provides a guide for cover 2 to slide along handle 1.

FIG. 7A, and its exploded view FIG. 7B, and FIG. 8 shows the attachment points and the mechanism of action of the three exemplified spring-actuated hinges 4 (one hinge 4 per each grapple 3).

One end of the spring mechanism 4 end is affixed to the shaft 10 near the shaft distal end, and the opposing spring end is affixed to the grapple 3 top, or proximal end. When the grapples 3 are closed, as shown in FIGS. 7A and 7B, the spring-actuated hinges 4 are in a vertically extended position. And when the grapples 3 are in an open position, as shown in FIG. 8, the spring-actuated hinges 4 are in a substantially compressed horizontal position, or in a substantially downward angled compressed position (e.g. about 40 degrees are less from the horizontal).

In an additional embodiment, the apparatus is able to fling the snowball formed within the grapples by simultaneously pushing on handle 1, or pulling handle 1 and cover 2 together, to open the grapples while swinging the apparatus in an arc—e.g. a throwing motion.

It is additionally noted and anticipated that although the apparatus is shown in its most simple form, various components and aspects of the apparatus may be differently shaped or slightly modified when forming the invention herein. As such those skilled in the art will appreciate the descriptions and depictions set forth in this disclosure or merely meant to portray examples of preferred modes within the overall scope and intent of the invention and are not to be considered limiting in any manner.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention or claims herein. Consequently, all such modifications and variations and substitutions are included within the scope of the invention as defined by the following claims.

What is claimed is:

1. A snowball forming apparatus, comprising:

a. a shaft member (10), with a proximal end and a distal end, a triangular cross-sectional area with three sides, and comprising an elongated tube with a user's handle (1) on the proximal end;

b. a substantially cone or funnel shaped cover member (2), with a proximal end and a distal end encircling and covering the shaft member up to the handle, wherein the shaft member is longitudinally slidable within the cover member;

c. three concave grapples (3) uniform in size and shape, connected to the shaft member distal end (14), and moveable between an open position to collect snow and release a snowball, or a closed position to form a spherical snowball; and d. wherein each grapple comprises a substantially pointed or curved bottom end (24) to facilitate piercing through and scooping up snow.

2. The snowball forming apparatus of claim 1, further comprising the handle (1) coating an apparatus proximal end (16) wherein the handle comprises a water-proof and non-slip material to enable a user to securely, and comfortably grasp the apparatus.

3. The snowball forming apparatus of claim 1, wherein the cover member further comprises: 1) a small circular top opening (12) on the cover proximal end to enable the shaft member to slide up and down within the cover without wobbling; and 2) a large circular bottom opening (20) on the cover distal end that is wide enough to fit the grapples in a closed position.

4. The snowball forming apparatus of claim 3, wherein when the apparatus is in an extended position with the handle and cover separated, the grapples are closed within the cover member; and when the apparatus is in a contracted position with the handle and cover touching, the grapples are open and positioned outside of the cover member.

5. The snowball forming apparatus of claim 1, further comprising a plurality of hinge mechanisms (4) on the shaft member distal end and connected to the grapples, wherein the hinge mechanism is able to open and close the grapples.

6. The snowball forming apparatus of claim 5, wherein the hinge mechanism comprises per each grapple, a spring actuated mechanism attached on one end to the shaft member distal end, and on an opposing end to a grapple top end (22); and the spring actuated mechanisms are able to simultaneously pull the grapples closed when the handle and cover are separated; and are able to simultaneously push the grapples open when the handle and cover are touching.

7. The snowball forming apparatus of claim 5, wherein each of the three sides of the shaft is attached to one grapple via one hinge mechanism.

8. A method of using a snowball forming apparatus, comprising:

a. providing a snowball forming apparatus comprising, a shaft member (10), with a proximal end and a distal end, a triangular cross-sectional area with three sides, and comprising an elongated tube with a user's handle (1) on the proximal end;

a substantially cone or funnel shaped cover member (12), with a proximal and a distal end, encircling and covering the shaft member up to the handle, wherein the shaft member is longitudinally slidable within the cover member;

three concave grapples (13), uniform in size and shape, connected to the shaft member distal end (14), and moveable between an open position to collect snow and release a snowball, or a closed position to form a spherical snowball;

wherein each grapple comprises a substantially pointed or curved bottom end (24) to facilitate piercing through and scooping up snow, b. pushing the shaft member downward through the cover member to extend and open the plurality of grapples;

c. positioning the grapples within loose snow until the grapples are completely covered in snow;

d. pulling on the shaft member upward through the cover member to retract and close the grapples inside the cover member, and to form a spherical snowball; and e. repeating step (b) to release the snowball.

9. The method of claim 8, further comprising the handle coating the shaft member proximal end (18), wherein the handle comprises a water-proof and non-slip material to enable a user to securely, and comfortably grasp the snowball forming apparatus.

10. The method of claim 8, wherein the cover member further comprises: 1) a small circular top opening (12) on the cover proximal end to enable the shaft member to slide up and down within the cover without wobbling; and 2) a large circular bottom opening (20) on the cover distal end that is wide enough to fit the grapples in a closed position.

11. The method of claim 10, wherein when the apparatus is in an extended position with the handle and cover separated, the grapples are closed within the cover member; and when the apparatus is in a contracted position with the handle and cover touching, the grapples are open and positioned outside of the cover member.

12. The method of claim 8, further comprising a plurality of hinge mechanisms (4) on the shaft member distal end and connected to the grapples, wherein the hinge mechanism is able to open and close the grapples.

13. The method of claim 12, wherein the hinge mechanism comprises per each grapple, a spring actuated mechanism attached on one end to the shaft member distal end, and on an opposing end to a grapple top end (22); and the spring actuated mechanisms are able to simultaneously pull the grapples closed when the handle and cover are separated; and are able to simultaneously push the grapples open when the handle and cover are touching.

14. The method of claim 12, wherein each of the three sides of the shaft is attached to one hinge mechanism.

15. The method of use of claim 8, wherein a user places one hand on the handle and one hand on the cover and moves the shaft member through the cover member by pushing and pulling on the handle and/or the cover.

16. The method of claim 8, further comprising a user throwing the snowball formed within the grapples by simultaneously moving the handle and the cover together to open the grapples, while swinging the apparatus in an arced motion.

* * * * *